US007318738B2

(12) United States Patent
Wells

(10) Patent No.: US 7,318,738 B2
(45) Date of Patent: Jan. 15, 2008

(54) ELECTRICAL CONNECTION DEVICE

(75) Inventor: Mark Wells, Dudley (AU)

(73) Assignee: Head Electrical International Pty Ltd, Dudley, NSW (AU)

( * ) Notice: Subject to any disclaimer, the term of this patent is extended or adjusted under 35 U.S.C. 154(b) by 0 days.

(21) Appl. No.: 10/551,370

(22) PCT Filed: Apr. 5, 2004

(86) PCT No.: PCT/AU2004/000443

§ 371 (c)(1),
(2), (4) Date: Jul. 26, 2006

(87) PCT Pub. No.: WO2004/088796

PCT Pub. Date: Oct. 14, 2004

(65) Prior Publication Data

US 2006/0281355 A1 Dec. 14, 2006

(30) Foreign Application Priority Data

Apr. 4, 2003 (AU) ..... 2003901612

(51) Int. Cl.
*H01R 13/62* (2006.01)

(52) U.S. Cl. ..... 439/310

(58) Field of Classification Search ..... 439/310, 439/153, 157, 610, 158
See application file for complete search history.

(56) References Cited

U.S. PATENT DOCUMENTS 1,947,481 A 2/1934 Meyer
2,860,226 A 11/1958 Williams et al.
3,156,512 A * 11/1964 Peterson et al. ..... 439/258
3,249,907 A 5/1966 Hewitson
4,152,038 A 5/1979 Inouye et al.
4,820,204 A 4/1989 Batty
4,874,328 A 10/1989 Le Dall et al.

(Continued)

FOREIGN PATENT DOCUMENTS

AU A-40728/85 10/1985

(Continued)

OTHER PUBLICATIONS

Australian International-Type Search Report, No. 2003901623, dated Apr. 16, 2003.

(Continued)

*Primary Examiner*—Phuong Dinh
(74) *Attorney, Agent, or Firm*—Portland Intellectual Property, LLC

(57) ABSTRACT

The present invention provides an electrical connection device for a machine cable comprising a first connector having a first contact and a second connector having a second contact the connectors being moveable between a disengaged condition in which the first and second contacts are remote from each other and an engaged condition in which the first and the second contacts are electrically connected. The device also comprises a drive for imparting a driving force to drive the first and the second connectors relative to each other whereby the first connector and the second connector move between the disengaged and the engaged positions. The drive is arranged to distribute the driving force around at least a portion of at least one of the first and the second connectors to minimize wedging, canting or seizing between connector surfaces and allows minimal mechanical clearance to provide a narrow path.

34 Claims, 4 Drawing Sheets

U.S. PATENT DOCUMENTS

| | | | |
|---|---|---|---|
| 4,934,963 | A | 6/1990 | Gardner et al. |
| 5,271,286 | A | 12/1993 | Vranish |
| 5,280,254 | A | 1/1994 | Hunter et al. |
| 5,580,282 | A | 12/1996 | Paterek |
| 6,039,604 | A | 3/2000 | Tindall |
| 6,042,424 | A | 3/2000 | LaCoy et al. |
| 6,045,389 | A | 4/2000 | Ferrill et al. |
| 6,077,122 | A | 6/2000 | Elkhatib et al. |
| 6,129,586 | A | 10/2000 | Bellemon |

FOREIGN PATENT DOCUMENTS

| | | | | |
|---|---|---|---|---|
| AU | 200035321 | A1 | | 5/2000 |
| AU | 200193330 | B2 | | 11/2001 |
| DE | 2502204 | A1 | | 7/1976 |
| EP | 0 151 710 | | | 8/1985 |
| FR | 2658005 | | | 8/1991 |
| GB | 1466643 | | * | 3/1977 |
| GB | 2239991 | A | | 7/1991 |
| WO | WO 99/08343 | | | 4/1998 |

OTHER PUBLICATIONS

International Publication No. WO 98/15037, dated Apr. 9, 1998, Metal Manufactures Limited, Application No. PCT/AU97/00651 filed Sep. 30, 1997.

International Search Report No. PCT/AU2004/000398, dated May 6, 2004, with Written Opinion dated May 11, 2004.

Australian Patent Application No. AU 2001 87239, filed Nov. 1, 2001, as published May 9, 2002, Consolidated Manufacturing Industries Ltd..

Australian Search Report No. 2003901612, dated Apr. 17, 2003.

International Search Report No. PCT No. AU2004/000443, dated Jun. 10, 2004, with Written Opinion dated Jun. 17, 2004.

* cited by examiner

ELECTRICAL CONNECTION DEVICE

FIELD OF THE INVENTION

The present invention broadly relates to an electrical connection device for a machine cable. Throughout this specification the term "machine cable" is used for any machine, reeling or trailing cable that is suitable to deliver power to mobile machinery such as machinery in petroleum or mining industry. The term "connector" is used for any plug, lug, electrical adaptor, coupler or receptacle.

BACKGROUND OF THE INVENTION

Machine cables are typically used to provide an electrical connection for mobile electrical machines. For example, in the mining or petroleum industry often large electrical machinery is used and each machine cable may have to provide power in the order of a few hundred kilowatts to a few megawatts. Typically such power is delivered with a voltage of one or more kilovolts. The cables usually comprise a plurality of cores and are connected using connectors including sockets and pins.

In an explosive environment, for example, particular precaution must be taken and a flame path may be required between the two connectors to reduce likelihood of explosions. The flame path typically is formed between a plug and a receptacle by positioning a cylindrical surface that surrounds contacts and/or electrical leads of the plug inside a respective cylindrical surface of the receptacle. The mechanical tolerance between the cylindrical surfaces is fine (typically 0.2 to 0.4 mm). As a consequence of the fine mechanical tolerance, canting or seizing may occur which makes it difficult to engage or disengage plug and receptacle.

It is known in the prior art to have a pawl and slot arrangement on a side of the plug and the receptacle which can be used to drive the plug and the receptacle together to engage pins and sockets and the surfaces that form the flame path.

SUMMARY OF THE INVENTION

The present invention provides in a first aspect an electrical connection device for a machine cable, the device comprising:

a first connector having a first contact, a second connector having a second contact, the first connector and the second connector being moveable between a disengaged condition in which the first and second contacts are remote from each other and an engaged condition in which the first and the second contacts are electrically connected and a drive for imparting a driving force to drive the first and the second connectors relative to each other whereby the first connector and the second connector move between the disengaged and the engaged positions, the drive being arranged to distribute the driving force around at least a portion of at least one of the first and the second connectors.

Each of the first and the second connectors typically comprises a housing. The first and the second connectors typically also comprise first and second flame path surfaces which are arranged so that one of the flame path surfaces surrounds the other flame path surface when the connectors are moved to the engaged position so as to define a flame path between the first and the second flame path surfaces. The first and the second flame path surfaces are typically arranged so that, when the first and the second connectors are moved to the engaged position, the flame path surfaces mate with a tolerance of less than 0.4 mm, typically less than 0.2 mm between them.

In the prior art the pawl and slot arrangement applies driving force at one particular location only. Consequently, mechanical wedging, canting or seizing between the connectors, especially of the tightly mating metallic flame-path surfaces, may occur and often large forces are required to connect the connectors and mate the flame-path surfaces. In practice; these large forces may even bend one of the metallic bodies of the connectors. In the present invention, however, the drive force is distributed around at least a portion of the first and/or the second connector and the likelihood of wedging, canting or seizing between the first and the second connector therefore is reduced or even inhibited.

The drive typically has a first drive part associated with the first connector and a second drive part associated with the second connector. The first drive part and the second drive part may be arranged so that the driving force is distributed substantially equally around the first and/or the second connector. The first drive part typically comprises a ring-like element and the second connector typically comprises an engagement surface which extends at least in part around the second connector. The engagement surface typically surrounds the second connector entirely and the ring-like element typically surrounds in use the engagement surface entirely. The ring-like element and the engagement surface typically are arranged to engage with each other and to distribute the driving force substantially equally around at least one of the first and the second connector. Alternatively, the drive may be arranged to distribute the drive force at discrete positions that at least in part surround at least one of the first and the second connector.

The first drive part and the second drive part typically are arranged so that the first and the second connectors can be driven relative to each other along a substantially linear path.

For example, the drive may comprise a geared arrangement. The geared arrangement of the drive may comprise a threaded drive and a threaded portion. The first drive part of the drive may be the threaded drive and the second drive part may the threaded portion.

The threaded portion of the geared arrangement typically forms the engagement surface. The threaded portion typically forms a part of the exterior surface of the second connector. The threaded portion of the geared arrangement may comprise a helical groove that is positioned so that an imaginary axis about which the helical groove is oriented is substantially parallel to the movement of the first connector and the second connector relative to each other.

For example, the ring-like element may be a toothed wheel of the threaded drive and the threaded drive may further comprise and a toothed shaft. The toothed wheel typically has a toothed inner peripheral surface and a toothed outer peripheral surface. The geared arrangement may be arranged so that the toothed shaft engages with the outer peripheral toothed surface of the ring-like toothed wheel. The inner peripheral toothed surface of the ring-like toothed wheel typically is arranged to engage with the helical groove. The toothed shaft may be rotatable but typically is captured in position relative to the first connector. The geared arrangement may be arranged so that a rotational motion of the toothed shaft is translated by the toothed wheel into a translational relative movement of the connectors.

One of the first and the second connectors may have an elongated groove such as a keyway on its outer peripheral surface that is oriented along the imaginary axis. In this case the other connector may have a projection such as a key that is arranged to slide in the elongated groove. The elongated groove and the projection may be arranged so that, in use, a rotation of the first connector relative to the second connector is avoided.

The first contact may be a pin and the second contact may be a socket. Alternatively, the first contact may be a socket and the second contact may be a pin. The pin may also be one of a plurality of pins and the socket may be one of a plurality of sockets.

The electrical connection device typically is suitable for delivery of a power of more than 100 kW or even more than 1 MW.

The present invention provides in a second aspect a method of connecting a first electrical connector with a second electrical connector, the first electrical connector having a first contact and the second electrical connector having a second contact, the first connector and the second connector being moveable between a disengaged condition in which the first and second contact are remote from each other and an engaged condition in which the first and second contacts are in electrical contact, the method comprising the steps of:

distributing a driving force around at least one of the first and the second connectors and driving the first and the second connector relative to each other so that the first connector and the second connector move between the disengaged and the engaged position.

The present invention provides in a third aspect a first electrical connector for a machine cable, the connector comprising:

a first contact and a drive part arranged for engagement with another drive part of another connector that has a second contact in a manner such that the first connector and the second connector are moveable between a disengaged condition in which the first and second contacts are remote from each other and an engaged condition in which the first and second contacts are in electrical contact wherein in use at least one of the first and the second drive parts imparts a driving force that is distributed around at least one of the connectors.

The invention will be more fully understood from the following description of specific embodiments of the invention. The description is provided with reference to the accompanying drawings.

DETAILED DESCRIPTION OF SPECIFIC EMBODIMENTS OF THE INVENTION

Referring to FIGS. 1 to 4, an electrical connection device according to specific embodiments of the invention is now described. In this embodiment, the electrical connection device comprises connector 10 and connector 50 or connector 10 and connector 70.

In this embodiment components of the connectors 10, 50 and 70 are sized and structured so that the electrical connection device is suitable for delivery of a few hundred kW or a few MW of power. Connector 10 is arranged for connection to a multi-core machine cable such as a 3-phase cable having three multi-strand cores. Connector 50 is a back-to-back receptacle (restrained coupling device) arranged to connect two of the connectors 10. Connector 70 is a receptacle for connecting the connector 10 to a electrical machine.

Figure 1:
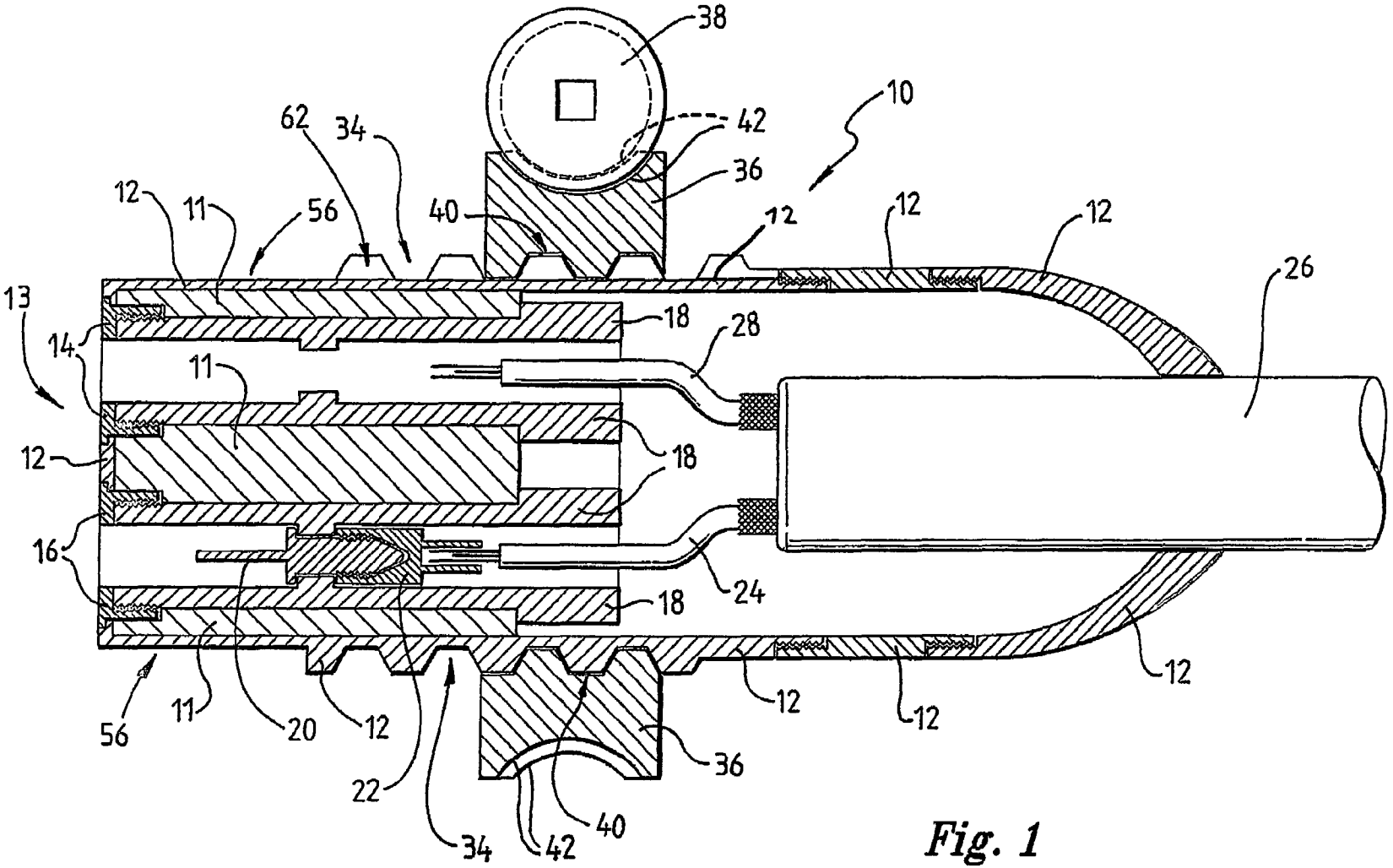
FIG. 1 shows a schematic representation (in part in cross-section) of a connector according to a specific embodiment of the invention.

Connector 10 is a plug that comprises an insulating body 11 which is of substantially cylindrical shape and an outer shell 12 composed of metallic and/or insulating polymeric material. The connector 10 has an end-face 13 that has three apertures (only two are shown in FIG. 1) that are defined by nuts such as nuts 14 and 16. From each aperture an insulating sleeve 18 projects inwardly. The pin 20 is connected to a thimble 22 which is connected to an individual core 24 of a multi-core machine cable 26. A further core 28 of the multi-core machine cable is also shown (not connected).

The outer shell 12 comprises a helical groove 34. FIGS. 1 to 4 also show a ring-like toothed wheel 36 and a toothed shaft 38. The inner toothed surface 40 of toothed wheel 36 is arranged for engagement (meshing) with the helical groove 34 and the outer toothed surface 42 is arranged for engagement (meshing) with the toothed shaft 38.

Figure 2:
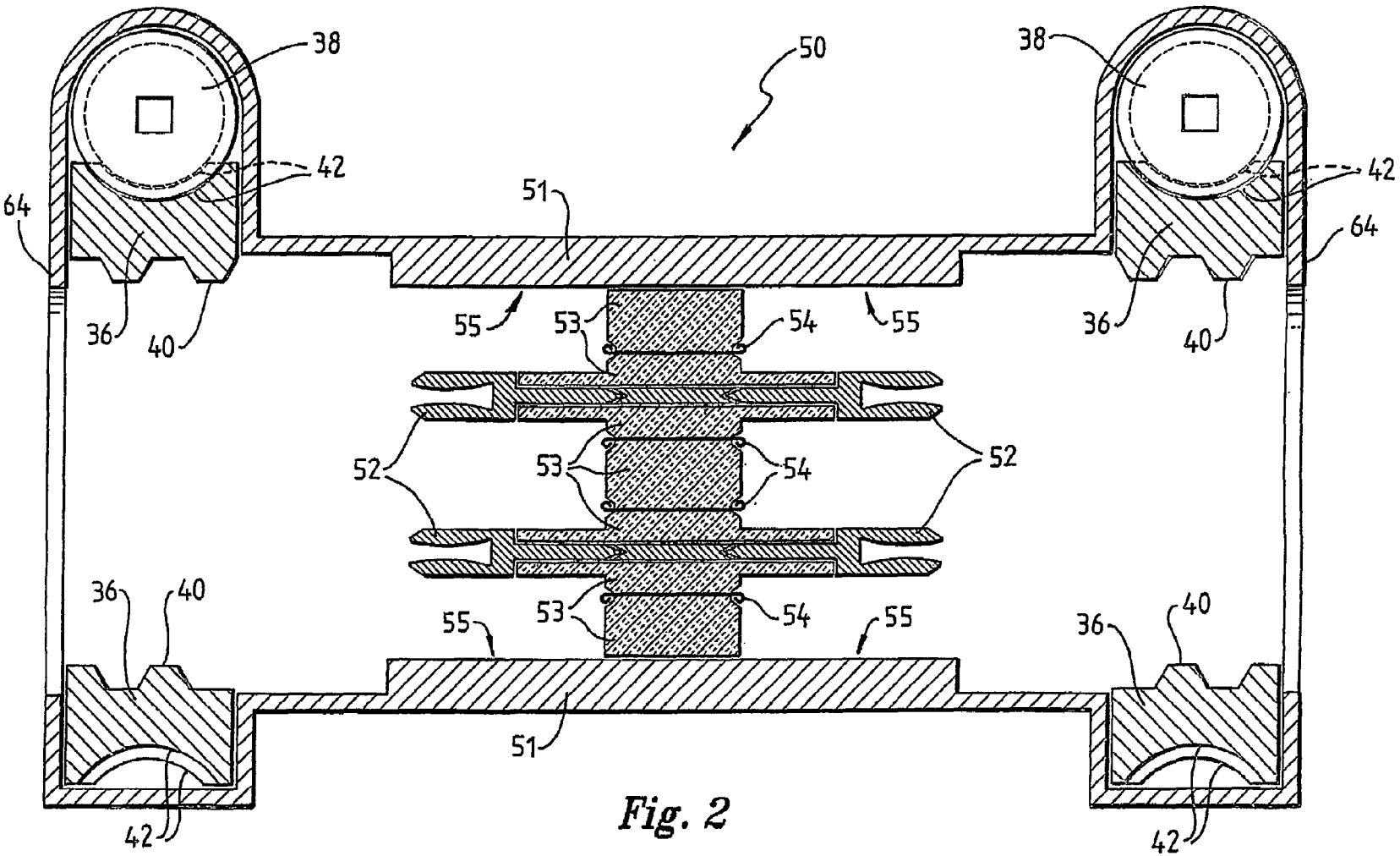
FIG. 2 shows a schematic cross-sectional representation of a connector according to another specific embodiment of the invention

FIG. 2 shows a receptacle 50 comprising an outer shell 51. The outer shell 51 locates the toothed shaft 38 and the toothed wheel 36 so that the toothed wheel 36 is rotatable about an imaginary longitudinal central axis of the receptacle 50 and the toothed shaft 38 is rotatable about a direction perpendicular to that. The receptacle 50 also comprises sockets 52 arranged for engagement with pins such as pin 20 shown in FIG. 1. Pairs of the sockets 52 are electrically connected and held in position by insulating body 53. The insulating body 53 also comprises earth connections 54.

Figure 3:
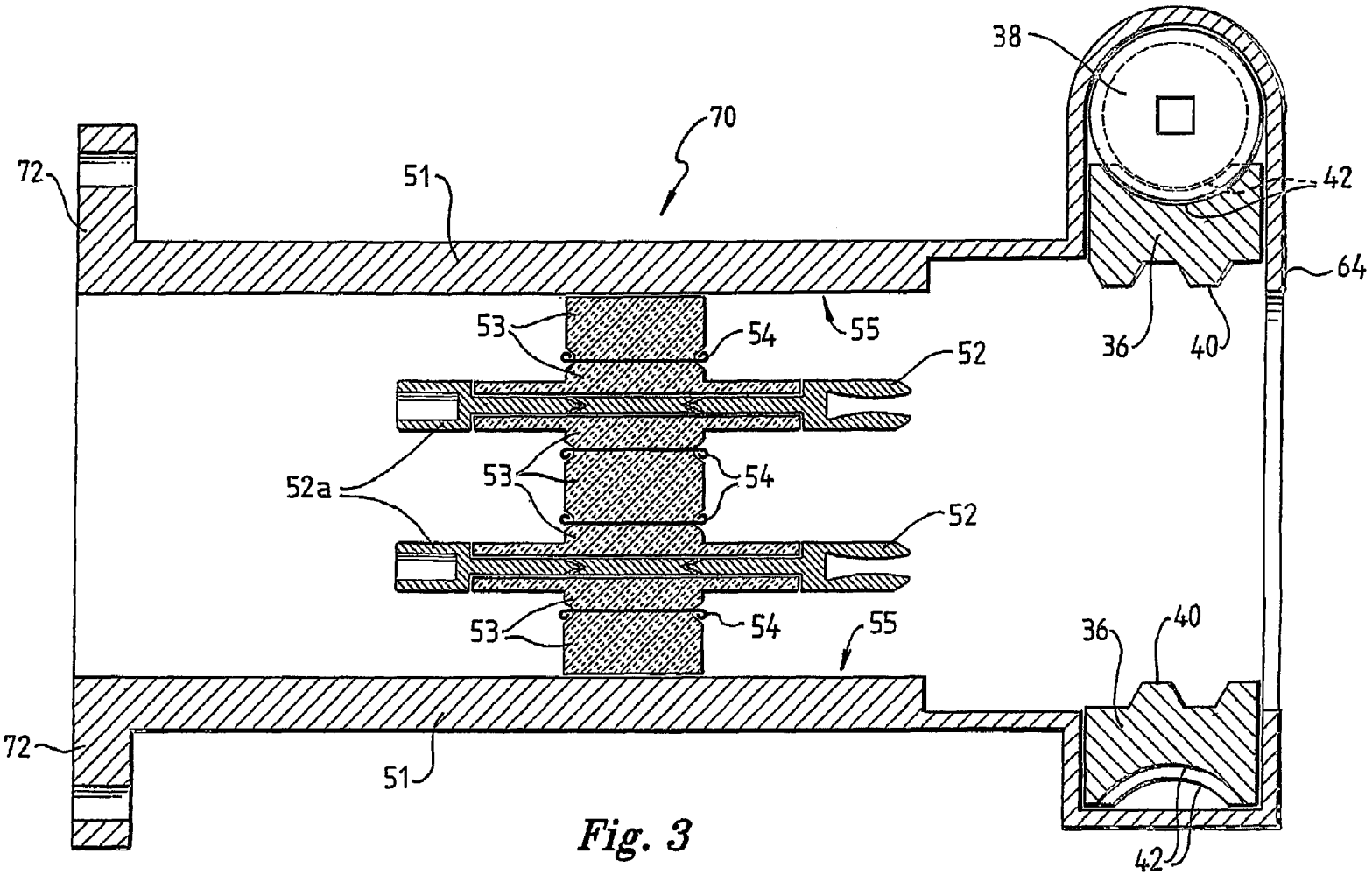
FIG. 3 shows a schematic cross-sectional representation of a connector according to further specific embodiment of the invention and FIG. 4 shows (a), (b) perspective views of toothed wheels, (c) a cross-sectional representation of a toothed shaft and (d) a perspective view of the toothed shaft according to embodiments of the invention.
Figure 4A:
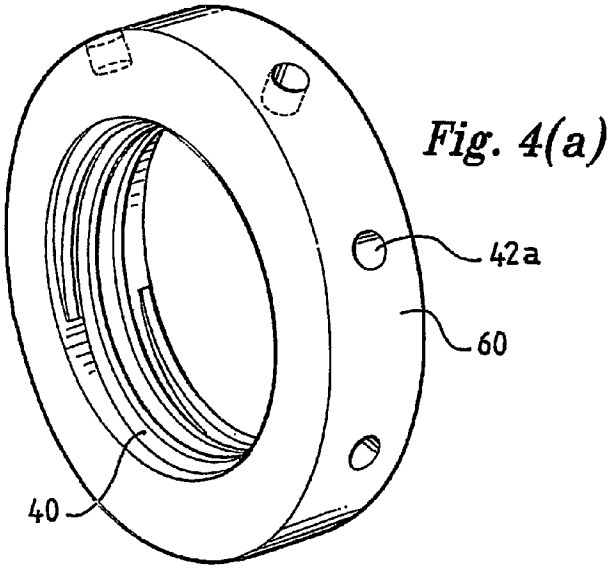
Figure 4B:
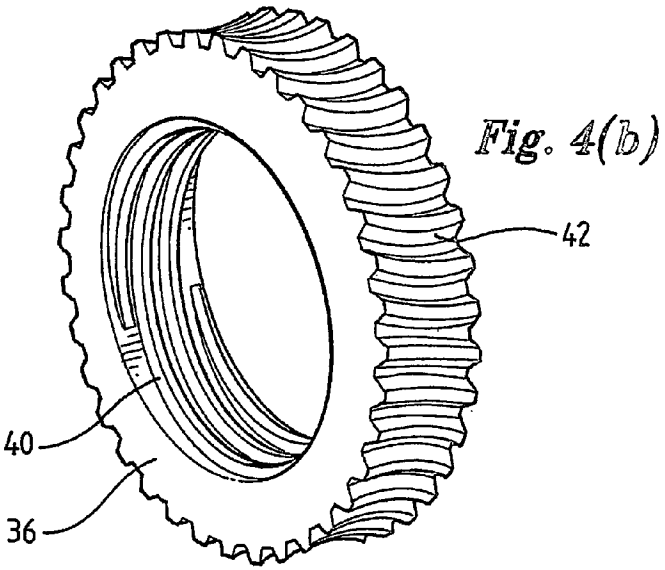
Figure 4C:
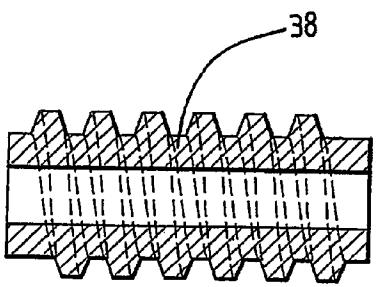
Figure 4D:
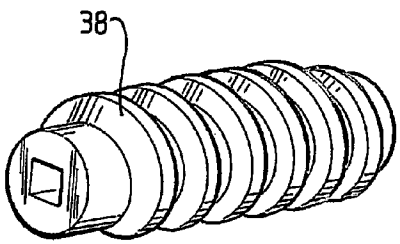

The receptacle 70 shown in FIG. 3 is related to that shown in FIG. 2, but in this case comprises thimbles 52*a* each arranged to receive an electrical conductor (not shown) which in use are guided into the housing of an electrical machine (not shown). Flange 72 is arranged for mechanical connection to the housing of the electrical machine.

When the plug 10 is engaged with receptacles 50 or 70, a flame path is defined between surface 55 (see FIG. 2 or 3) and surface 56 (see FIG. 1). Surfaces 55 and 56 are shaped so that the mechanical tolerance between the mated surfaces is of the order of 0.2 to 0.4 mm. In this specific example surface 55 has a diameter of 92.3 to 92.4 mm and surface 56 has a diameter of 92.0 to 92.1 mm. The surfaces 55 and 56 are metallic and arranged so that, if an electrical flame occurs with the connected connectors 10 and 50 or 10 and 70, gaseous material can escape along a narrow flame path defined between the surfaces 55 an 56 to release pressure from the connected connectors 10 and 50 or 10 and 70. However, because of the tight tolerances and the metallic nature of the flame path surfaces 55 and 56, the gaseous material is cooled when it escapes the flame path surfaces so that the likelihood of an explosion is reduced. In this embodiment the surfaces 55 and 56 have a length of the order of 100 mm.

FIG. 4(*b*) shows the toothed wheel 36 in greater detail. FIG. 4(*a*) a toothed wheel 60 according to a variation of this embodiment. In this case the toothed wheel comprises an inner toothed portion for engagement with helical groove 34 and the outer periphery has a number of recesses 42*a* for reception of a lever (not shown). The lever may be used to turn the toothed wheel 60. In this case, no toothed shaft such as toothed shaft 38 or toothed surface 42 are required.

The tooth wheel 36 and the toothed shaft 38 form a worm-drive and a rotational motion of the toothed shaft 38 is translated into a rotational motion of the toothed wheel 36. The rotational motion of the toothed wheel 36 is translated into a linear movement of the receptacle 50 relative to the plug 10 whereby pins such as pin 20 and sockets 52 as well as metallic flame path surfaces 55 and 56 move between a disengaged and an engaged condition.

In this embodiment the plug 10 also has a longitudinal keyway 62 in form of a groove that extends on the outer shell 12 across helical groove 34 in a direction parallel to the imaginary axis about which the helical groove 34 is wound. The receptacles 50 and 70 have a key 64 in form of a projection that is arranged to slide in the keyway 62. The keyway 62 and the key 64 therefore avoid a rotation of the plug 10 relative to the receptacle 50 or 70. The keyway 62 and the key 64 may be positioned on the connectors 10 and 50 or 70 respectively so that only connectors of a predetermined type can be connected. For example, connectors for respective applications may have keyways and keys at respective positions on the connectors so that the keys and the keyways only allow connection of the respective connectors. Further, each connector may have more than one key or keyway.

Although the invention has been described with reference to particular examples, it will be appreciated by those skilled in the art that the invention may be embodied in many other forms. For example, the device may comprise a plug and a receptacle and a plurality of substantially equally spaced apart drive arrangements may surround the plug or the receptacle. In this case the drive arrangements may be arranged to impart driving forces at spaced apart positions. Also, the ring-like toothed wheel may have a toothed portion on one of its side surfaces arranged for engagement with a toothed shaft such as shaft 38. Further, it will be understood that the device is not limited to one connector being a plug and the other connector being a receptacle. For example, both connectors may be suitable plugs or one of them may be a lug.

The invention claimed is:

1. An electrical connection device for a machine cable, comprising:

a first connector having a first contact;

a second connector having a second contact, the first connector and the second connector being moveable between a disengaged condition in which the first and second contacts are remote from each other and an engaged condition in which the first and the second contacts are electrically connected; and a drive for imparting a driving force to drive the first and the second connectors relative to each other whereby the first connector and the second connector move between the disengaged and the engaged positions, the drive comprising a geared arrangement and being arranged to distribute the driving force around at least a portion of at least one of the first and the second connectors.

2. The electrical connection device as claimed in claim 1 wherein each of the first and the second connectors comprises a housing and wherein the first connector comprises a first flame path surface and second connector comprises a second flame path surface, the flame path surfaces being arranged so that one of the flame path surfaces surrounds the other flame path surface when the connectors are moved to the engaged position so as to define a flame path between the flame path surfaces.

3. The electrical connection device as claimed in claim 2 wherein the tolerance between the first and the second flame path surfaces are arranged to mate with a tolerance of less than 0.4 mm between them.

4. The electrical connection device as claimed in claim 3 wherein the tolerance is less than 0.2 mm.

5. The electrical connection device as claimed in claim 1 wherein the drive has a first drive part associated with the first connector and a second drive part associated with the second connector.

6. The electrical connection device as claimed in claim 5 wherein the first drive part and the second drive part are arranged so that the driving force is distributed substantially equally around at least one of the first and the second connector and wherein the first drive part comprises a ring-like element.

7. The electrical connection device as claimed in claim 6 wherein the second connector comprises an engagement surface which extends at least in part around the second connector.

8. The electrical connection device as claimed in claim 7 wherein the engagement surface surrounds the second connector entirely and the ring-like element of the first connector surrounds the engagement surface entirely.

9. The electrical connection device as claimed in claim 7 wherein the ring-like element and the engagement surface are arranged to engage with each other and to distribute the driving force substantially equally around at least one of the first and the second connector.

10. The electrical connection device as claimed in claim 8 wherein the ring-like element and the engagement surface are arranged to engage with each other and to distribute the driving force substantially equally around at least one of the first and the second connector.

11. The electrical connection device as claimed in claim 1 wherein the drive is arranged to distribute the drive force at discrete positions that at least in part surround at least one of the first and the second connector.

12. The electrical connection device as claimed in claim 5 wherein the first drive part and the second drive part are arranged so that the connectors can be driven relative to each other along a substantially linear path.

13. The electrical connection device as claimed in claim 5 wherein the geared arrangement comprises a threaded drive and a threaded portion and wherein the first drive part is a threaded drive and the second drive part is a threaded portion.

14. The electrical connection device as claimed in claim 7 wherein the geared arrangement comprises a threaded drive and a threaded portion, the first drive part being a threaded drive and the second drive part being a threaded portion and wherein the threaded portion of the geared arrangement forms the engagement surface.

15. The electrical connection device as claimed in claim 14 wherein the threaded portion of the geared arrangement forms a part of the exterior surface of the second connector.

16. The electrical connection device as claimed in claim 15 wherein the threaded portion of the geared arrangement comprises a helical groove that surrounds the second connector and is positioned so that an imaginary axis about which the helical groove is wound is substantially parallel to the movement of the first contact and the second contact relative to each other.

17. The electrical connection device as claimed in claim 16 wherein the ring-like element is a toothed wheel of the threaded drive and the threaded drive comprises and a toothed shaft.

18. The electrical connection device as claimed in claim 17 wherein the toothed wheel of the geared arrangement has a toothed inner peripheral surface and a toothed outer peripheral surface.

19. The electrical connection device as claimed in claim 18 wherein the geared arrangement is arranged so that the toothed shaft engages with the outer peripheral toothed surface of the ring-like toothed wheel.

20. The electrical connection device as claimed in claim 17 wherein the ring-like toothed wheel has a toothed portion on one of its side surfaces arranged for engagement with the toothed shaft.

21. The electrical connection device as claimed in claim 16 wherein the ring-like toothed wheel comprises an inner toothed portion for engagement with the helical groove and the outer periphery of the ring-like toothed wheel has a number of recesses for reception of a lever.

22. The electrical connection device as claimed in claim 18 wherein the inner peripheral toothed surface of the ring-like toothed wheel is arranged to engage with the helical groove.

23. The electrical connection device as claimed in claim 16 wherein the toothed shaft of the geared arrangement is rotatable but captured in position relative to the first connector.

24. The electrical connection device as claimed in claim 16 wherein the geared arrangement is arranged so that a rotational motion of the toothed shaft is translated by the toothed wheel into a translational relative movement of the connectors.

25. The electrical connection device as claimed in claim 24 wherein one of the first and the second connectors has an elongate groove on its outer peripheral surface and is oriented along the imaginary axis and the other connector has a projection that is arranged to slide in the elongate groove.

26. The electrical connection device as claimed in claim 25 wherein the elongate groove and the projection are arranged so that, in use, a rotation of the first connector relative to the second connector is avoided.

27. The electrical connection device as claimed in claim 1 wherein the first contact is a pin and the second contact is a socket.

28. The electrical connection device as claimed in claim 1 wherein the first contact is a socket and the second contact is a pin.

29. The electrical connection device as claimed in claim 26 wherein the socket is one of a plurality of sockets and the pin is one of a plurality of pins.

30. The electrical connection device as claimed in claim 27 wherein the socket is one of a plurality of sockets and the pin is one of a plurality of pins.

31. The electrical connection device as claimed in claim 1 being suitable for delivery of a power of more than 100 kW.

32. The electrical connection device as claimed in claim 1 being suitable for the delivery of more than 1 MW.

33. A method of connecting a first electrical connector with a second electrical connector, the first electrical connector having a first contact and the second electrical connector having a second contact, the first connector and the second connector being moveable between a disengaged condition in which the first and second contacts are remote from each other and an engaged condition in which the first and second contacts are in electrical contact, the method comprising the steps of:

distributing a driving force around at least one of the first and the second connectors; and driving the first and the second connector relative to each other using a geared arrangement so that the first connector and the second connector move between the disengaged and the engaged position.

34. A first electrical connector for a machine cable, the connector comprising:

a first contact; and a drive part comprising a geared arrangement and being arranged for engagement with another drive part of another connector that has a second contact in a manner such that the first connector and the second connector are moveable between a disengaged condition in which the first and second contacts are remote from each other and an engaged condition in which the first and second contacts are in electrical contact, wherein in use at least one of the first and the second drive parts imparts a driving force that is distributed around at least one of the connectors.

* * * * *